US008922127B2

(12) United States Patent
Tanaya et al.

(10) Patent No.: US 8,922,127 B2
(45) Date of Patent: Dec. 30, 2014

(54) HIGH-FREQUENCY DISCHARGE IGNITION COIL APPARATUS AND HIGH-FREQUENCY DISCHARGE IGNITION APPARATUS

(71) Applicant: Mitsubishi Electric Corporation, Chiyoda-ku, Tokyo (JP)

(72) Inventors: Kimihiko Tanaya, Chiyoda-ku (JP); Naoki Itoi, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/052,438

(22) Filed: Oct. 11, 2013

(65) Prior Publication Data

US 2014/0306617 A1 Oct. 16, 2014

(30) Foreign Application Priority Data

Apr. 16, 2013 (JP) ..... 2013-085412

(51) Int. Cl.

| | |
|---|---|
| ***F02P 3/08*** | (2006.01) |
| ***H05B 37/02*** | (2006.01) |
| ***H05B 39/04*** | (2006.01) |
| ***H05B 41/00*** | (2006.01) |
| ***H01T 15/00*** | (2006.01) |

(52) U.S. Cl.

CPC ..... *H01T 15/00* (2013.01)
USPC ..... 315/209 CD; 315/111.41; 315/111.51; 315/209 T; 315/209 M

(58) Field of Classification Search

None
See application file for complete search history.

(56) References Cited

U.S. PATENT DOCUMENTS

| | | | | |
|---|---|---|---|---|
| 8,807,124 | B2 * | 8/2014 | Tanaya | 123/605 |
| 2014/0116405 | A1 * | 5/2014 | Tanaya | 123/634 |

FOREIGN PATENT DOCUMENTS

| | | | |
|---|---|---|---|
| JP | 05-093750 | A | 4/1993 |
| JP | 08-064358 | A | 3/1996 |
| JP | 2012-112310 | A | 6/2012 |
| JP | 2013-040582 | A | 2/2013 |

OTHER PUBLICATIONS

Japanese Office Action, issued Feb. 12, 2014, Application No. 2013-085412.

* cited by examiner

*Primary Examiner* — Anh Tran
(74) *Attorney, Agent, or Firm* — Sughrue Mion, PLLC; Richard C. Turner

(57) ABSTRACT

Provided is a compact ignition coil apparatus that can realize reliable insulation breakdown and spark discharge with high discharge current. A high-frequency discharge ignition coil apparatus includes: a capacitor 116 connected to a high-voltage terminal, for preventing passage of high voltage; and an inductor 117 connected to the capacitor 116 and forming, together with the capacitor 116, a band pass filter that allows only a predetermined frequency component to pass. High-frequency current is supplied from outside to the inductor 117. The high-frequency discharge ignition coil apparatus further includes a current level detection device 115 for detecting the level of current flowing in the inductor 117. The current level detection device 115 is placed in one package, together with a primary coil 111, a secondary coil 112, a capacitor 116, and an inductor 117.

7 Claims, 3 Drawing Sheets

HIGH-FREQUENCY DISCHARGE IGNITION COIL APPARATUS AND HIGH-FREQUENCY DISCHARGE IGNITION APPARATUS

BACKGROUND OF THE INVENTION

1. Field of the Invention

The present invention relates to a high-frequency discharge ignition coil apparatus and a high-frequency discharge ignition apparatus, mainly used for driving an internal-combustion engine.

2. Description of the Background Art

In recent years, problems such as environmental conservation and fuel depletion have arisen, and there is an urgent need to address such problems in automobile industry.

As an example of efforts to address such problems, there is a method of dramatically improving fuel consumption by engine downsizing and weight reduction using a supercharger.

It is known that in a highly supercharged state, the pressure in an engine combustion chamber becomes extremely high even when combustion is not occurring, and in this situation, it is difficult to cause spark discharge for starting combustion.

One of the reasons for the difficulty is that required voltage for causing insulation breakdown between (in the gap) a high-voltage electrode of an ignition plug and a GND (ground) electrode becomes extremely high, and then exceeds the withstand voltage of an insulator portion of the ignition plug.

In order to solve the above problem, study for increasing the withstand voltage of the insulator portion has been conducted. However, in actual, it is difficult to ensure sufficient withstand voltage for the requirement, and there is no choice but to employ means of narrowing the gap interval of the ignition plug.

However, if the gap of the ignition plug is narrowed, then the influence of the quenching operation by the electrode portion becomes large, so that problems such as reduction in starting performance and reduction in combustion performance arise.

In order to solve the above problems, avoidance means of giving, by spark discharge, energy exceeding heat taken by the quenching operation of the electrode portion, or causing combustion at a position as far possible from the electrode, is conceivable. For example, an ignition coil apparatus as shown in Patent Document 1 is proposed.

In the ignition coil apparatus disclosed in Patent Document 1 (Japanese Laid-Open Patent Publication No. 2012-112310), while spark discharge is caused in the gap of the ignition plug by using a conventional ignition coil, high-frequency current is applied to a path of the spark discharge via a mixer using a capacitor, thus making it possible to cause spark discharge with high energy and form discharge plasma spreading more widely than normal spark discharge.

The conventional ignition coil apparatus shown in Patent Document 1 separates or couples a high-voltage system and a large current system by using a high withstand voltage capacitor.

Generally, a capacitor has a temperature characteristic, and its capacitance varies in accordance with variation in the environmental temperature.

The conventional ignition coil apparatus shown in Patent Document 1 has a problem that, since AC current corresponding to the pass frequency band of the capacitor is applied to the path of spark discharge, if the characteristic of the capacitor varies by the temperature, the level of current applied to the path of spark discharge greatly varies, so that current cannot be applied stably.

SUMMARY OF THE INVENTION

The present invention has been made to solve the above problems in the conventional apparatus, and an object of the present invention is to provide a high-frequency discharge ignition coil apparatus and a high-frequency discharge ignition apparatus capable of, even if the capacitor capacitance varies by variation in the environmental temperature, stably applying desired AC current to a path of spark discharge and efficiently forming large discharge plasma.

A high-frequency discharge ignition coil apparatus according to the present invention includes: a primary coil for generating and accumulating magnetic flux by application of current thereto; a secondary coil for generating predetermined high voltage by releasing the accumulated energy, the secondary coil magnetically coupled with the primary coil and having one end connected to a high-voltage terminal for supplying energy to an external apparatus; a capacitor connected to the high-voltage terminal, for preventing passage of the high voltage; and an inductor connected to the capacitor and forming, together with the capacitor, a band pass filter that allows only a predetermined frequency component to pass. High-frequency current is supplied from outside to the inductor. The high-frequency discharge ignition coil apparatus further comprising a current level detection device for detecting the level of current flowing in the inductor. The current level detection device is placed in one package, together with the primary coil, the secondary coil, the capacitor, and the inductor.

A high-frequency discharge ignition apparatus according to the present invention includes: the high-frequency discharge ignition coil apparatus; a high-frequency power supply for supplying high-frequency electric energy to the inductor; and a control circuit for controlling the output of the high-frequency power supply in accordance with a signal, detected by the current level detection device.

According to the high-frequency discharge ignition coil apparatus of the present invention, even if the environmental temperature varies or there are variations in constants of apparatuses, the current level can be controlled to a desired level, and high-energy discharge can be realized with a compact configuration and with high efficiency.

In addition, according to the high-frequency discharge ignition apparatus of the present invention, since large AC discharge current can be supplied between electrodes of an ignition plug in an early cycle, high-energy discharge is realized with a simple configuration and with high efficiency, large discharge plasma is formed, and starting performance and combustion performance are not impaired even if an ignition plug with a narrow gap is used. Therefore, improvement in the thermal efficiency owing to weight reduction and compression ratio increase by highly supercharged downsizing, and the like can be realized. Therefore, it becomes possible to dramatically reduce fuel used for driving an engine, whereby the discharge amount of CO2 can be greatly reduced, thus making contribution to environmental conservation.

The foregoing and other objects, features, aspects and advantages of the present invention will become more apparent from the following detailed description when read in conjunction with the accompanying drawings.

DETAILED DESCRIPTION OF THE PREFERRED EMBODIMENTS OF THE INVENTION

First Embodiment

A high-frequency discharge ignition coil apparatus according to the first embodiment of the present invention is an apparatus that causes spark discharge in a main plug gap of an ignition plug by high voltage caused by a high-frequency discharge ignition coil, and applies high-frequency AC current to a spark discharge path, thereby forming large discharge plasma in the main plug gap.

Figure 1A:
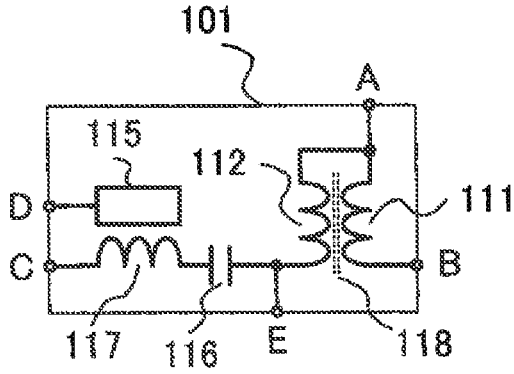
FIGS. 1A and 1B are configuration diagrams of a high-frequency discharge ignition coil apparatus according to the first embodiment of the present invention.

FIG. 1A is a configuration diagram of a high-frequency discharge ignition coil apparatus 101 according to the first embodiment. In FIG. 1A, the high-frequency discharge ignition coil apparatus 101 includes: a primary coil 111 for generating and accumulating magnetic flux by application of current thereto; a secondary coil 112 magnetically coupled with the primary coil 111, for generating predetermined high voltage by releasing accumulated energy, and supplying energy to an external apparatus; a capacitor 116 connected in series to one terminal of the secondary coil 112, for preventing passage of the high voltage; an inductor 117 connected to the capacitor 116 and forming, together with the capacitor 116, a band pass filter that allows only a predetermined frequency component to pass; and a current level detection device 115 for detecting the level of current flowing in the inductor 117. The primary coil 111, the secondary coil 112, the capacitor 116, the inductor 117, and the current level detection device 115 are placed in one package.

In FIG. 1A, one end of the primary coil 111 is connected to a terminal A, and the other end is connected to a terminal B. In addition, one end of the secondary coil 112 is connected to the terminal A, and the other end is connected to a terminal E.

The primary coil 111 and the secondary coil 112 are magnetically coupled with each other via a core 118. One terminal of the capacitor 116 is connected to the terminal E which is a high-voltage terminal, and the other end is connected to the inductor 117. The other end of the inductor 117 is connected to a terminal C.

In addition, one end of the current level detection device 115 is connected to a terminal D.

FIG. 18 is a configuration diagram showing another example of the high-frequency discharge ignition coil apparatus 101, in which a resistor 119 for suppressing noise in a capacitance current system is added to the configuration shown in FIG. 1A. The resistor 119 is connected in series between the terminal E and one end of the secondary coil 112.

Figure 1B:
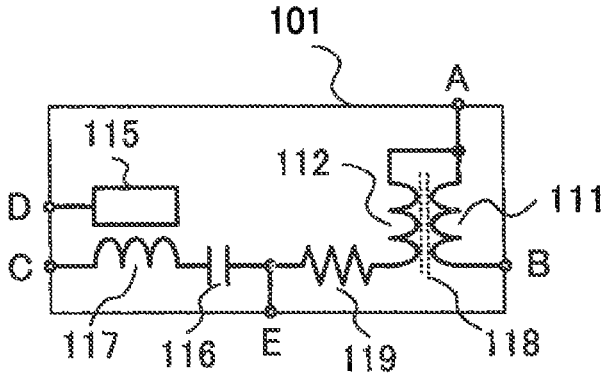

In the high-frequency discharge ignition coil apparatus 101 shown in FIGS. 1A and 1B, the terminal A is connected to a battery, and the terminal B is connected to a switching device (not shown) for controlling current application to the primary coil 111. The terminal C is connected to a high-frequency power supply (not shown) for supplying high-frequency current. The terminal D is connected to a control apparatus (not shown) for controlling the output of the high-frequency power supply in accordance with a signal detected by the current level detection device 115. The terminal E is connected to an ignition plug, to form an ignition apparatus for an engine.

Thus, in the first, embodiment, the high-frequency discharge ignition coil apparatus includes: the primary coil 111 for generating and accumulating magnetic flux by application of current thereto; the secondary coil 112 for generating predetermined high voltage by releasing the accumulated energy, the secondary coil 112 magnetically coupled with the primary coil and having one end connected to the high-voltage terminal for supplying energy to an external apparatus; the capacitor 116 connected to the high-voltage terminal, for preventing passage of the high voltage; and the inductor 117 connected to the capacitor 116 and forming, together with the capacitor 116, a band pass filter that allows only a predetermined frequency component to pass. In addition, high-frequency current is supplied from outside to the inductor 117. Further, the current level detection device 115 for detecting the level of current flowing in the inductor 117 is provided. The current level detection device 115 is placed in one package, together with the primary coil 111, the secondary coil 112, the capacitor 116, and the inductor 117.

Owing to such a configuration, it becomes possible to realize a high-frequency discharge ignition coil apparatus with a compact configuration, capable of controlling the current level to a desired current level even if the environmental temperature varies or there are variations in constants of devices.

Particularly, since the current level detection device 115 is placed in one package, together with the primary coil 111, the secondary coil 112, the capacitor 116, and the inductor 117, the cost can be reduced and the space can be saved as compared to the case where a current transformer for current detection is provided inside a high-frequency power supply 103.

Second Embodiment

The configuration of a high-frequency discharge ignition apparatus according to the second embodiment of the present invention will be described with reference to FIG. 2.

Figure 2:
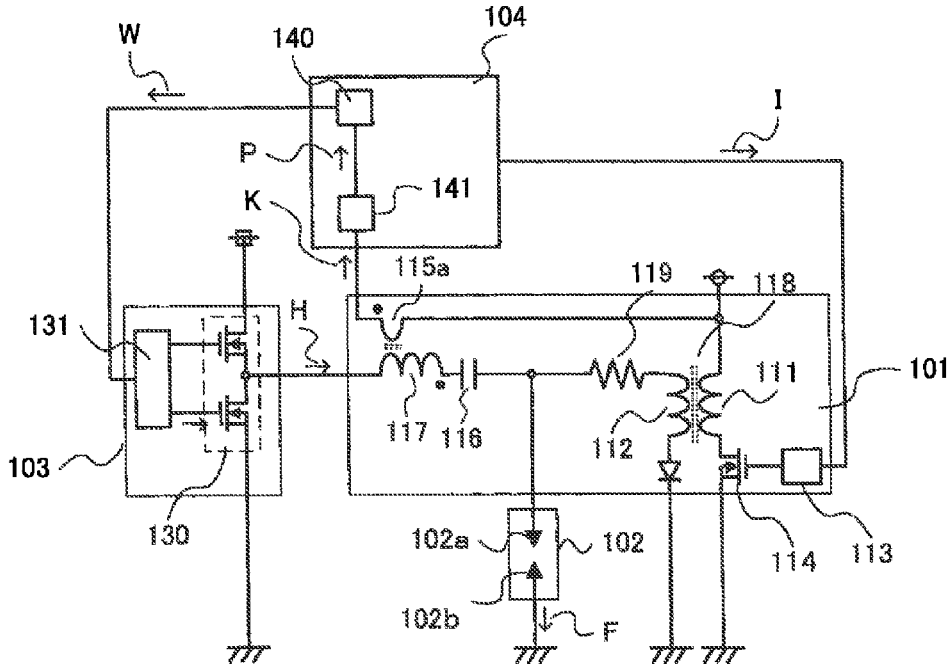
FIG. 2 is a circuit configuration diagram of a high-frequency discharge ignition apparatus according to the second embodiment of the present invention.

In FIG. 2, the high-frequency discharge ignition apparatus includes: an ignition plug 102; a high-frequency discharge ignition coil apparatus 101 for applying predetermined high voltage to the ignition plug 102 and supplying high-frequency AC current thereto; a high-frequency power supply 103 for supplying high-frequency electric energy to the high-frequency discharge ignition coil apparatus 101; the high-frequency discharge ignition coil apparatus 101; and a control apparatus 104 for controlling the output of the high-frequency power supply 103.

The ignition plug 102 includes a high-voltage electrode 102*a* as a first electrode, and an outside electrode 102*b* as a second electrode which faces to the high-voltage electrode 102*a* via a main plug gap which is a predetermined gap.

The high-frequency power supply 103 includes: a switching circuit 130 with a half-bridge configuration, connected to the inductor 117 of the high-frequency discharge ignition coil apparatus 101; and a driver device 131 for driving the switching circuit 130, and supplies high-frequency energy to the high-frequency discharge ignition coil apparatus 101.

The control apparatus 104 includes: a microprocessor 140 for determining and controlling the operation manners of the high-frequency discharge ignition coil apparatus 101 and the high-frequency power supply 103 in accordance with the operation state and the current level detected by the current level detection device 115; and an interface 141 for receiving a detection signal from the current level detection device 115 and sending the detection signal to the microprocessor 140.

The high-frequency discharge ignition coil apparatus 101 includes: the primary coil 111 and the secondary coil 112 magnetically coupled with each other via the core 118; a switching device 114 for controlling current application to the primary coil 111; a driver device 113 for driving the switching device 114; and the resistor 119 for suppressing noise in a capacitance current system caused when insulation breakdown is caused between (in the main plug gap) the high-voltage electrode 102*a* and the outside electrode 102*b* of the ignition plug 102.

One end of the secondary coil 112 is connected to the high-voltage electrode 102*a* of the ignition plug 102 via the resistor 119. One end of the capacitor 116 is directly connected to the high-voltage electrode 102*a* of the ignition plug 102.

The resistor 119 is provided for suppressing noise. In the case where noise hardly occurs owing to the configuration of an engine or the wiring state, the resistor 119 need not be provided. In this case, the one end of the secondary coil 112 is directly connected to the high-voltage electrode 102*a* of the ignition plug 102, and also the one end of the capacitor 116 is directly connected to the high-voltage electrode 102*a* of the ignition plug 102.

In order to reduce noise or enhance the efficiency, the switching device 114 and the driver device 113 may be provided inside the high-frequency discharge ignition coil apparatus 101. Alternatively, for the purpose of downsizing an engine, lowering the center of gravity of an engine, or the like, and in order to reduce the size and the weight of the high-frequency discharge ignition coil apparatus, the switching device 114 and the driver device 113 may be provided outside the high-frequency discharge ignition coil apparatus 101, for example, inside the control apparatus 104 or inside the high-frequency power supply 103.

In addition, the high-frequency discharge ignition coil apparatus 101 includes: the capacitor 116 and the inductor 117 forming a band pass filter for passing high-frequency current supplied from the high-frequency power supply 103 and blocking high voltage occurring on the secondary coil 112 so as not to be applied to the high-frequency power supply 103; and a detection coil 115*a* as a current level detection device for detecting the level of current flowing in the inductor 117, the detection coil 115*a* being magnetically coupled with the inductor 117.

The detection coil 115*a* forming the current level detection device is wound in the same direction as the inductor 117.

In the case where a side of the inductor 117 connected to the capacitor 116 is defined as the start side of winding, the start side of winding of the detection coil 115*a* is connected to the control apparatus 104 and the finish side of winding is connected to a battery. If the winding direction or the connection of the detection coil 115*a* differs, current flowing in the inductor 117 cannot be detected efficiently, and a trouble such as great reduction in the detection level, distortion of detected waveform, or increase in detection error, occurs.

Since the finish side of winding of the detection coil 115*a* is connected to a battery, determination of whether or not there is disconnection on a wire between the detection coil 115*a* and the control apparatus 104 can be facilitated.

In such cases where it is not necessary to perform determination about wire disconnection, wiring or configuration is desired to be simplified, or the accuracy of detection is desired to be enhanced, the finish side of winding of the detection coil 115*a* may be connected to a GND (ground).

Together with a method of the disconnection determination, the operation of the high-frequency discharge ignition apparatus according to the second embodiment will be described with reference to a timing chart shown in FIG. 3.

Figure 3:
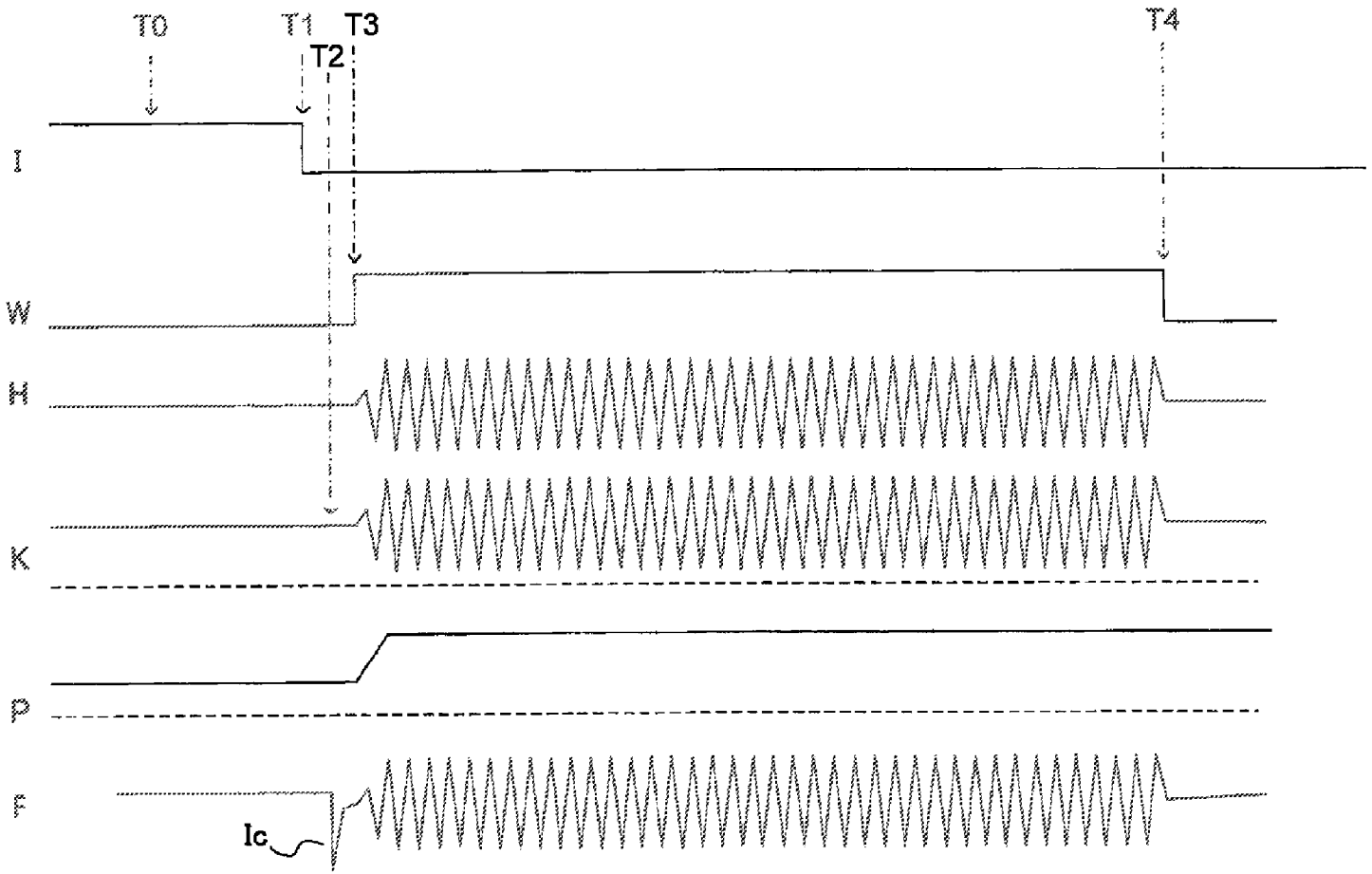
FIG. 3 is a timing chart showing the operation of the high-frequency discharge ignition apparatus according to the second embodiment.

FIG. 3 is a timing chart showing, in time series, a signal at each section in FIG. 2.

A signal I in FIG. 3 is a signal whose positive direction is the arrow direction on a path I in FIG. 2. The signal I is a voltage signal outputted from the control apparatus 104, for driving the high-frequency discharge ignition coil apparatus 101.

A signal W in FIG. 3 is a signal whose positive direction is the arrow direction on a path W in FIG. 2. The signal W is a voltage signal outputted from the control apparatus 104 and supplied to the driver device 131 in the high-frequency power supply 103, and indicates a period during which the switching circuit 130 is operated.

A signal H in FIG. 3 is a signal whose positive direction is the arrow direction on a path H in FIG. 2. The signal H is a current signal indicating output current of the high-frequency power supply 103.

A signal K in FIG. 3 is a signal on a path K in FIG. 2, and is a current signal detected by the detection coil 115*a*.

A signal P in FIG. 3 is a signal on a path P in FIG. 2, which is a resultant signal of peak-holding by the interface 141.

A signal F in FIG. 3 is a signal whose positive direction is the arrow direction on a path F in FIG. 2. The signal F is a current signal indicating discharge current flowing a spark discharge path formed in the main plug gap of the ignition plug 102.

At a timing T0 in FIG. 3, since the signal I has already become HIGH, the switching device 114 in the high-frequency discharge ignition coil apparatus 101 is in ON state, and the primary coil 111 is in current-applied state. Therefore, magnetic flux energy is being accumulated in the core 118.

At a timing T1, when the signal I is switched to LOW, current application to the primary coil 111 is interrupted by the switching device 114 in the high-frequency discharge ignition coil apparatus 101, and the magnetic flux energy accumulated in the core 118 is released. Then, induced voltage occurs on the secondary coil 112, so that induced current starts to flow, and meanwhile, charging of the ground capacitance that the ignition plug 102 potentially has and charging of the capacitor 116 are started.

At a timing T2, when charged voltage of the ground capacitance of the ignition plug 102 and charged voltage of the capacitor 116 have reached the insulation breakdown voltage of the main plug gap of the ignition plug 102, insulation breakdown occurs in the main plug gap, so that a spark discharge path is formed. Then, current due to discharge of the electric charge accumulated in the capacitance, i.e., so-called capacitance current Ic flows into the spark discharge path.

In order that AC current is applied from about the time when the capacitance current Ic has stopped, the control apparatus 104 switches the signal W to HIGH at a timing T3, to permit the operation of the switching circuit 130.

The interval from the timing T1 to the timing T3 may be set at a map value or a calculated value determined in accordance with the operation state.

This is because if the states such as the engine rotation rate, load, and the temperature have varied, the insulation breakdown voltage in the main plug gap also varies, and along with this, the timing T2 varies.

For example, in an idling state at about 700 rotation/minute, the interval from the timing T1 to the timing T3 is set at 50 microseconds. In a full load state at about 4000 rotation/minute, the interval from the timing T1 to the timing T3 is set at 100 microseconds.

In addition, when the temperature of engine cooling water has exceeded 80° C., 10 microseconds are uniformly subtracted.

When the operation of the switching circuit 130 is permitted by the signal W, the switching circuit 130 starts switching operation so as to send AC current into the spark discharge path formed in the main plug gap.

In the second embodiment, since the switching circuit 130 has a half-bridge configuration and the band pass filter formed by the inductor 117 and the capacitor 116 is provided at the stage subsequent to the switching circuit 130, the driver device 131 operates the HIGH-side switch and the LOW-side switch of the half bridge so that the HIGH-side switch and the LOW-side switch are alternately turned ON or OFF, along with the resonance frequency of the band pass filter.

By switching the half-bridge circuit along with the resonance frequency of the band pass filter, the impedance of the band pass filter section is minimized, and output current of the high-frequency power supply 103 flowing on the path H is maximized. Therefore, the maximum AC current can be sent into the spark discharge path in the main plug gap.

By the release of the magnetic flux energy accumulated in the core 118, current obtained by summing induced current (about 50 m to 300 mA) flowing in the secondary coil 112 and output current (about 2 to 10 A) of the high-frequency power supply 103 flows on the spark discharge path formed in the main plug gap as shown by the signal F.

At a timing T4, the control apparatus 104 switches the signal W to LOW to stop the operation of the driver device 131.

When the driver device 131 has stopped, supply of large AC current to the spark discharge path in the main plug gap is also stopped.

It is noted that the interval from the timing T3 to the timing T4 and the level of AC current to be applied may be set at a map value or a calculated value set depending on the operation state, the discharge state, or the like.

For example, in the case where the temperature of engine cooling water is lower than 80° C., when the engine rotation rate is equal to or smaller than 1000 rotation/minute, AC current discharge with the peak of 5 A is applied during an interval of 500 microseconds. When the rotation rate exceeds 3000 rotation/minute, AC current discharge with the peak of 5 A is applied during an interval of 300 microseconds. Then, when the rotation rate exceeds 4000 rotation/minute, AC current discharge with the peak of 3 A is applied during an interval of 300 microseconds.

In the case where the temperature of engine cooling water is higher than 80° C., 100 microseconds are uniformly subtracted from the interval from the timing T3 to the timing T4.

Here, it is known that generally, a capacitor has a temperature characteristic in which the capacitance decreases as the temperature increases, and the capacitance increases as the temperature decreases.

For example, the high-frequency discharge ignition coil apparatus 101 is assumed to be directly attached to the engine.

That is, such problems that heat is transferred from the engine, the environmental temperature greatly changes by the influence of the warm-up state of the engine, and the capacitance value the capacitor 116 greatly changes, arise.

If the capacitance value of the capacitor 116 forming the band pass filter has changed, naturally, the resonance frequency and the frequency characteristic of the band pass filter also change.

As described above, if deviation from the resonance frequency of the band pass filter has occurred, the impedance of the band pass filter section increases. As a result, the situation where desired current cannot be applied to the path H, can occur.

For example, it will be assumed that, in a certain operation condition, AC current with the peak of 5 A is required to be applied to the path H.

In addition, it will be assumed that when the temperature is 30° C., the capacitance value of the capacitor 116 is 100 pF.

At this time, it will be assumed that, in order to apply AC current of a target level to the path H, the microprocessor 140 gives an instruction so that the switching circuit 130 will operate at a frequency of 2 megahertz, and thus AC current with the peak of 5 A actually flows on the path H.

Then, it will be assumed that, while the engine is continuously operating, the engine temperature increases and the temperature of the capacitor 116 also increases to 80° C., so that the capacitance value of the capacitor 116 has decreased to about 80 pF.

At this time, the resonance frequency of the band pass filter has shifted to be higher than in the case of 30° C.

In the case where the microprocessor 140 has given an instruction so that the switching circuit 130 will operate at a frequency of 2 megahertz as described above, since the impedance of the band pass filter has increased, only AC current with the peak of 3 A flows on the path H. As a result, deviation from the target current level occurs, so that such a trouble that large discharge plasma cannot be formed occurs.

On the other hand, it will be assumed that after the engine is stopped, at the time when the engine is restarted, the engine has been completely cooled and the temperature of the capacitor 116 has decreased to 0° C.

At this time, it will be assumed that the capacitance value of the capacitor 116 has increased to about 120 pF.

In the case where the microprocessor 140 has given an instruction so that the switching circuit 130 will operate at a frequency of 2 megahertz, since the impedance of the band pass filter has decreased at this time, AC current with the peak of 8 A flows on the path H.

As a result, deviation from the target current level occurs, and current larger than necessary flows into the ignition plug 102, so that such a trouble that the high-voltage electrode 102*a* or the outside electrode 102*b* erodes, can occur.

In order to eliminate such deviation between the required condition and the actual condition, in the high-frequency discharge ignition apparatus of the second embodiment, while the level of current flowing in the inductor 117 is monitored, if the current level decreases relative to the requirement, the operation frequency of the switching circuit 130 is controlled such that the current level becomes a desired level.

In order to monitor the level of current flowing in the inductor 117, the detection coil 115*a* as a current detection device is provided on a path of the magnetic flux of the inductor 117, whereby a signal corresponding to the current level can be obtained.

This signal is a current signal flowing on the path K in FIG. 2, which is represented by the signal K shown in FIG. 3.

Since one end of the detection coil 115*a* is connected to a battery terminal as described above, a signal shifted by an amount of the battery voltage is obtained.

Here, disconnection determination for the path K will be described.

In the state where the path K is conductive, when current is not flowing in the inductor 117, a signal at a constant level equal to a signal of the battery voltage is obtained.

When current is flowing in the inductor 117, a signal as shown by K in FIG. 3 is obtained. If the path K is disconnected, the level of an obtained signal is fixed at a zero level (dashed line).

Similarly, in the state where the path. K is conductive, when current is not flowing in the inductor 117, the peak-held output of the interface 141 is fixed at the battery level, and when current is flowing in the inductor 117, the output becomes a level corresponding to the current level shown by P in FIG. 3. If the path K is disconnected, the output becomes a zero level (dashed line). Thus, the microprocessor 140 can determine that the path K is disconnected, as described above.

The signal K is inputted to the interface 141 in the control apparatus 104.

The interface 141 has a peak-holding configuration.

The microprocessor 140 in the control apparatus 104 takes in the signal K by using an A/D converter in order to determine the level of the signal K.

In order to take in a high-frequency AC signal in a megahertz band by using an A/D converter to perform data processing, an expensive A/D converter or an expensive microcomputer with high performance is needed. Therefore, in the second embodiment, the interface 141 formed by a peak-holding circuit is prepared so that a signal level can be read by using an inexpensive microprocessor and an inexpensive A/D converter for general purpose.

After the signal taking processing through A/D conversion is finished, the microprocessor 140 resets the peak-held value.

The microprocessor 140 reads the signal P peak-held by the interface 141, after the timing T4, and then compares the read level with a required current level.

If it is determined that the signal level is different from the required current level beyond tolerance, the driver device 131 is instructed to control the operation frequency of the switching circuit 130 so that the signal level will become the required level.

In this case, the switching circuit 130 may be always controlled at a frequency in a region higher than the resonance frequency of the band pass filter.

As a result, the switching frequency can be uniquely determined such that if the signal level is lower than the target level, the switching frequency is decreased, and if the signal level is higher than the target level, the switching frequency is increased.

As a matter of course, the switching circuit 130 may be always controlled at a frequency in a region lower than the resonance frequency of the band pass filter.

In this case, the above theory just inverts.

For example, it will be assumed that, when a required current level is 5 A, the microprocessor 140 gives an instruction for switching at 2 megahertz.

In this case, if the read value of the signal P taken in via the interface 141 after detection by the detection coil 115*a* is 3 A, the microprocessor 140 controls the switching frequency of the switching circuit 130 so as to be decreased by one step.

For example, if one step is 100 kilohertz, an instruction is given so that the switching frequency becomes 1.9 megahertz.

In the next ignition cycle, if the read value of the signal P is 4 A, in the case where the tolerance is ±0.5 A, the frequency is decreased by one step again so that the frequency becomes 1.8 megahertz.

Then, if the read value of the signal P indicates 5.1 A upon the next confirmation, since the read value falls within a range of ±0.5 A from the target value of 5 A, the microprocessor 140 instructs the driver device 131 to keep the present switching frequency.

When the temperature of the capacitor 116 has increased after a certain period of operation, the resonance frequency of the band pass filter shifts to a higher region.

At this time, if the read value of the signal P becomes 5.6 A, the microprocessor 140 gives an instruction to increase the switching frequency by one step, thereby controlling the switching circuit 130 so that the switching frequency becomes 1.9 megahertz. Then, if the read value of the signal P becomes 4.6 A, the microprocessor 140 instructs the driver device 131 to keep the present switching frequency.

As described above, the high-frequency discharge ignition apparatus according to the second embodiment of the present invention includes the high-frequency discharge ignition coil apparatus 101, and further includes: the high-frequency power supply 103 for supplying high-frequency energy to the inductor 117; and the control circuit for controlling the operation of the high-frequency power supply 103 based on a signal detected by the current level detection device 115, whereby even if the environmental temperature varies or there are variations in constants of devices, the current level can be controlled to a desired current level, unnecessary consumption of the ignition plug electrode is prevented, large discharge plasma is efficiently formed, and starting performance and combustion performance are not impaired even if an ignition plug with a narrow gap is used. Therefore, improvement in the thermal efficiency owing to weight reduction and compression ratio increase by highly supercharged downsizing, and the like can be realized. Therefore, it becomes possible to dramatically reduce fuel used for driving the internal-combustion engine, whereby the discharge amount of CO2 can be greatly reduced, thus making contribution to environmental conservation.

Particularly, in the case where the current level detection device 115 is formed by the detection coil 115*a* for detecting the magnetic flux of the inductor 117, it is not necessary to separately prepare a large and expensive component such as a current transformer, but it is only necessary to add one winding for detection to the already provided inductor 117 for resonance, whereby current applied to the ignition plug 102 can be detected with almost no influence on the main circuit, and further, cost reduction and space saving can be realized.

The high-frequency discharge ignition apparatus according to the present invention can be provided on an automobile, a two-wheel vehicle, an outboard engine, and other special machines using an internal-combustion engine, so that ignition of fuel can be reliably performed. Therefore, the internal-combustion engine can be operated with high efficiency, thus serving for solving a fuel depletion problem and the environmental conservation.

It is noted that, within the scope of the present invention, the above embodiments may be freely combined with each other, or each of the above embodiments may be modified or abbreviated as appropriate.

Various modifications and alterations of this invention will be apparent to those skilled in the art without departing from the scope and spirit of this invention, and it should be understood that this is not limited to the illustrative embodiments set forth herein.

What is claimed is:

1. A high-frequency discharge ignition coil apparatus comprising:

a primary coil for generating and accumulating magnetic flux by application of current thereto;

a secondary coil for generating predetermined high voltage by releasing the accumulated energy, the secondary coil magnetically coupled with the primary coil and having one end connected to a high-voltage terminal for supplying energy to an external apparatus;

a capacitor connected to the high-voltage terminal, for preventing passage of the high voltage; and an inductor connected to the capacitor and forming, together with the capacitor, a band pass filter that allows only a predetermined frequency component to pass, wherein high-frequency current is supplied from outside to the inductor, the high-frequency discharge ignition coil apparatus further comprising a current level detection device for detecting the level of current flowing in the inductor, wherein the current level detection device is placed in one package, together with the primary coil, the secondary coil, the capacitor, and the inductor.

2. The high-frequency discharge ignition coil apparatus according to claim 1, wherein the secondary coil is connected to the high-voltage terminal via a resistor for suppressing radiated noise.

3. The high-frequency discharge ignition coil apparatus according to claim 1, wherein the current level detection device is composed of a detection coil for detecting the magnetic flux of the inductor.

4. The high-frequency discharge ignition coil apparatus according to claim 3, wherein the detection coil composing the current level detection device is a coil wound in the same direction as the inductor, with respect to the magnetic flux of the inductor, and in the case where a side connected to the capacitor is a start side of winding of the inductor, a start side of winding of the coil is used as a detection terminal for the level of current flowing in the inductor, and a finish side of winding of the coil is connected to a terminal having predetermined voltage or to a GND.

5. A high-frequency discharge ignition apparatus comprising:

the high-frequency discharge ignition coil apparatus according to claim 1;

a high-frequency power supply for supplying high-frequency electric energy to the inductor; and a control circuit for controlling the output of the high-frequency power supply in accordance with a signal detected by the current level detection device.

6. The high-frequency discharge ignition apparatus according to claim 5, wherein the high-frequency power supply includes a switching circuit connected to the inductor, and the control apparatus controls the operation frequency of the switching circuit in accordance with the signal detected by the current level detection device.

7. The high-frequency discharge ignition apparatus according to claim 5, wherein the control circuit determines whether or not there is a disconnection on a current path including the current level detection device, based on the signal detected by the current level detection device.

* * * * *